US010753055B2

(12) United States Patent
Tosolini et al.

(10) Patent No.: US 10,753,055 B2
(45) Date of Patent: Aug. 25, 2020

(54) ANTI-VEHICLE DEVICES FOR A MODULAR ANTI-VEHICLE BARRIER AND METHOD FOR MAKING SAID MODULAR ANTI-VEHICLE BARRIER

(71) Applicant: EPS ITALIA SRL, Tavagnacco (UD) (IT)

(72) Inventors: Luca Tosolini, Tavagnacco (IT); Luca Giubilato, Tavagnacco (IT)

(73) Assignee: EPS ITALIA SRL, Travagnacco (UD) (IT)

( * ) Notice: Subject to any disclaimer, the term of this patent is extended or adjusted under 35 U.S.C. 154(b) by 0 days.

(21) Appl. No.: 16/201,530

(22) Filed: Nov. 27, 2018

(65) Prior Publication Data

US 2019/0218731 A1 Jul. 18, 2019

(30) Foreign Application Priority Data

Nov. 28, 2017 (IT) ..... 102017000136596

(51) Int. Cl.

| | |
|---|---|
| ***E01F 15/00*** | (2006.01) |
| ***E01F 15/14*** | (2006.01) |
| ***E01F 13/02*** | (2006.01) |
| ***E01F 13/12*** | (2006.01) |

(52) U.S. Cl.
CPC ..... *E01F 15/14* (2013.01); *E01F 13/02* (2013.01); *E01F 13/12* (2013.01)

(58) Field of Classification Search
CPC ..... E01F 15/14; E01F 13/02; E01F 13/12
USPC ..... 404/6–9, 72
See application file for complete search history.

(56) References Cited

U.S. PATENT DOCUMENTS

| | | | | |
|---|---|---|---|---|
| 4,973,189 | A | 11/1990 | Bechtold | |
| 7,819,604 | B2 * | 10/2010 | Breed | B60R 19/00 256/13.1 |
| 8,277,143 | B2 * | 10/2012 | Adler | E01F 9/685 256/13.1 |
| 9,127,422 | B2 * | 9/2015 | Ball | E01F 13/12 |
| 9,217,229 | B2 * | 12/2015 | Ball | E01F 13/12 |
| 2006/0090408 | A1 * | 5/2006 | Darcy | E01F 13/12 52/174 |

(Continued)

FOREIGN PATENT DOCUMENTS

WO WO 2010/132616 11/2010

*Primary Examiner* — Raymond W Addie
(74) *Attorney, Agent, or Firm* — Leason Ellis LLP

(57) ABSTRACT

A modular anti-vehicle barrier comprising a plurality of anti-vehicle devices provided with respective tubular support elements, which are spaced apart from one another and have respective vertical reference axes, respective regular polygonal shaped bases, which are designed to support said tubular support elements and are mutually arranged in abutment against the relative sides, fastening means designed to mutually connect the bases in order to form a single body, which constitutes a base of the anti-vehicle barrier; friction means, which are interposed between the bases and the upper bearing surface of the ground and are structured for countering by friction the movement of the anti-vehicle barrier caused by an impact of a vehicle against the same, a plurality of ballasts, which are designed to be coupled, in an easily removable manner, to the tubular support elements for adjusting the weight and/or the height of the modular anti-vehicle barrier.

4 Claims, 9 Drawing Sheets

(56) References Cited

U.S. PATENT DOCUMENTS

| | | | | |
|---|---|---|---|---|
| 2007/0086858 | A1* | 4/2007 | Morgan | E01F 13/12 404/6 |
| 2008/0112756 | A1* | 5/2008 | Omar | E01F 13/12 404/9 |
| 2008/0205982 | A1* | 8/2008 | Hubbell | E01F 15/003 404/6 |
| 2008/0304909 | A1* | 12/2008 | McCue | E01F 15/003 404/6 |
| 2009/0028638 | A1* | 1/2009 | Crawford | E01F 13/12 404/6 |
| 2009/0035061 | A1* | 2/2009 | Crawford | E01F 13/026 404/6 |
| 2009/0208285 | A1* | 8/2009 | Adler | E01F 13/00 404/6 |
| 2009/0250674 | A1* | 10/2009 | Darcy | E01F 13/12 256/13.1 |
| 2011/0027015 | A1* | 2/2011 | O'Connell | E01F 13/046 404/6 |
| 2014/0010591 | A1 | 1/2014 | Ball | |
| 2015/0376849 | A1 | 12/2015 | Thompson et al. | |
| 2017/0204575 | A1 | 7/2017 | Klein | |

* cited by examiner

ANTI-VEHICLE DEVICES FOR A MODULAR ANTI-VEHICLE BARRIER AND METHOD FOR MAKING SAID MODULAR ANTI-VEHICLE BARRIER

CROSS-REFERENCE TO RELATED APPLICATIONS

This patent application claims priority from Italian patent application no. 102017000136596 filed on Nov. 28, 2017, the entire disclosure of which is incorporated herein by reference.

TECHNICAL FIELD

The invention relates to the creation of a temporary, modular anti-vehicle barrier, of the sectional and non-sectional type, through anti-vehicle devices.

In particular, the invention relates to a barrier system designed to mitigate a terrorist attack involving penetrating a protected area by means of a motor vehicle, for example a car, a van or a truck, to which the description below will make explicit reference without because of this loosing in generality.

BACKGROUND OF THE INVENTION

In the last few years there has been a significant increase in the number of terrorist attacks carried out using cars or trucks in order to hit crowds gathered in streets and squares, thus causing actual massacres. This has led to the need to have safety and protection barriers designed to mitigate these attacks in given risk areas.

A currently frequently adopted solution involves the use of fixed barriers, which are permanent and cannot be moved. These barriers usually comprise elements or items that are firmly fixed to the ground. Some anti-vehicle barriers, for example, consist of vertical tubular columns, so-called bollards, made of cement or metal, which have their lower base firmly fixed to the ground.

The permanent protection barriers described above suffer from the drawback of being very complex and expensive to be manufactured, as they require the formation of excavations and foundations especially made to fit the bases into the ground, the removal of the soil resulting from the digging and fastening means to fix the bases of the columns to the ground, for example through concrete or anchors.

The permanent barriers described above are further affected from the technical problem of not being a suitable solution when the protection needed is merely temporary, namely when, at the end of an event, the protected area must be quickly freed from the barrier, so as to allow for the free circulation of vehicles in the area.

To this aim, modular anti-vehicle barrier of the removable type have been designed, which, indeed, can be easily installed and removed before and, respectively, at the end of the event.

Some modular anti-vehicle barriers that are frequently used comprise concrete "Jersey" barriers, which are generally arranged so as to rest on the bearing surface of the ground in positions next to one another, so as to delimit the area to be protected. However, the effectiveness of modular anti-vehicle barriers with "Jersey" modules in mitigating terrorist attacks has some limits. As a matter of fact, "Jersey" modules were conceived for road applications aimed at channelling vehicle flows.

"Jersey" modules, on the one hand, are not suited to neutralize, namely stop, in an effective manner the vehicle used for the attack and, on the other hand, are subjected to being moved, especially in case the impact takes place in a front manner at an end thereof. This displacement can generate an opening, which allows the vehicle to dangerously reach the inside of the protected area.

Furthermore, the operations to be carried out for the transportation and the installation of concrete "Jersey" modules are particularly complicated and expensive, due to the weight and the dimensions thereof.

Another type of modular anti-vehicle barrier of the removable type is described in US patent application US 2017 020 457 5.

This anti-vehicle barrier is provided with a plurality of foldable metal anti-vehicle devices, each basically provided with a first and a second rectangular frame, which are mutually hinged so as to be folded relative to one another between a rest position and an operating protection position. In the rest position, the first and the second frame are close to one another so as to reduce the dimensions and make the transportation easier. In the operating protection position, the first frame rests horizontally on the ground and the second frame is open in an approximately vertical position. This modular anti-vehicle barrier effectively counters the penetration of the vehicle only in one specific impact direction, in which the wheels of the vehicle try to overcome the first frame. The vehicle stopping action of the barrier requires the anti-vehicle device to wedge itself between the front wheels of the vehicle and the ground. During this action, the anti-vehicle device is dragged by the impacting vehicle for some metres on the ground, until its stops.

The barrier described above is affected by the limit of allowing the vehicle to penetrate, even though partially, the area to be protected, with all the consequent risks for the people standing close to the barrier. Another limit of the barrier described above lies in the fact the impact of the vehicle damages the anti-vehicle device.

However, there is the need to manufacture a barrier that is capable, on the one hand, of stopping the vehicle regardless of its direction and, on the other hand, of neutralizing the action of the vehicle in a small space, so as to reduce the risk of the vehicle continuing its ride in the protected area.

To this purpose, the Applicant carried out a study aimed at offering an anti-vehicle barrier which is economic, practical and capable of overcoming the drawbacks mentioned above.

SUMMARY OF THE INVENTION

This object is reached by this invention for it relates to: a modular anti-vehicle barrier, an anti-vehicle device for achieving said modular anti-vehicle barrier, and a method for achieving the modular anti-vehicle barrier, as set forth in the appended claims.

BRIEF DESCRIPTION OF THE DRAWINGS

The invention will now be described with reference to the accompanying drawings, which show a non-limiting embodiment thereof, wherein.

DETAILED DESCRIPTION OF THE INVENTION

The invention will now be described in detail with reference to the accompanying Figures, so as to allow a person skilled in the art to carry it out and to use it. Possible changes to the embodiments described will be immediately evident to skilled people and the generic principles described can be applied to other embodiments and applications without for this reason going beyond the scope of protection of the invention as it is defined in the appended claims. Therefore, the invention cannot be considered as limited to the embodiments described and shown herein, but it has to be associated with the widest scope of protection possible in accordance with the principles and the features described and claimed herein.

Figure 1:
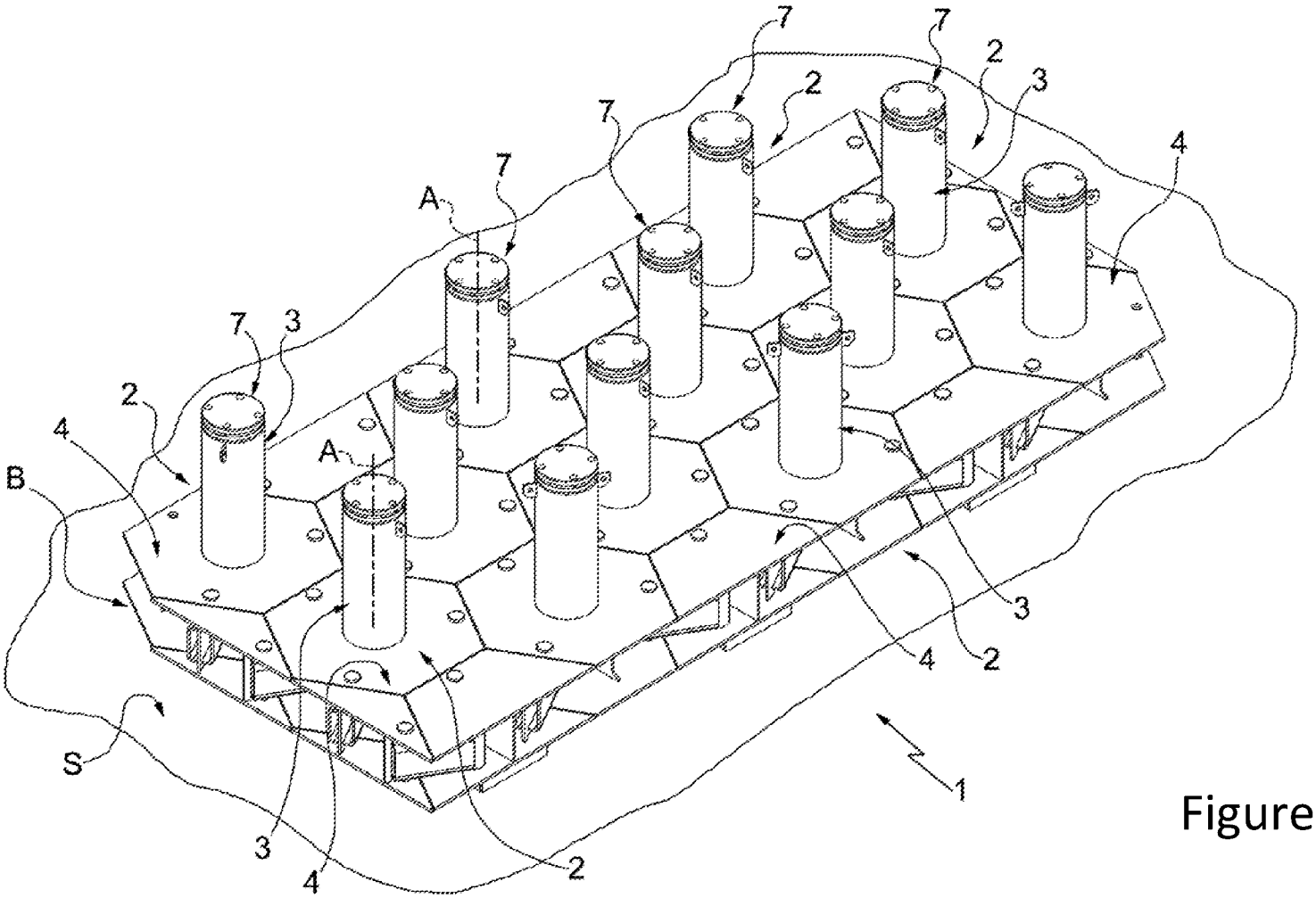
FIG. 1 is an axonometric view of a modular anti-vehicle barrier according to the details of the invention.

With reference to FIG. 1, number 1 indicates, as a whole, a modular anti-vehicle barrier of the temporary type, whose elements can easily be combined with one another and then disassembled and which is structured so as to rest on an upper bearing surface of the ground S of an area to be protected. In particular, the anti-vehicle barrier is structured so as to mitigate, namely neutralize/stop, during a terrorist attack, the penetration of a vehicle, such as for example a car, a van or a truck or any other similar motor vehicle, in a predetermined area. The modular anti-vehicle barrier 1 according to the invention conveniently is free from any anchoring/fixing to the ground S. In other words, the modular anti-vehicle barrier 1 is arranged so as to freely rest on the upper surface of the ground S and, therefore, has no anchoring/fastening means designed to make it integral to the ground S.

With reference to the preferred embodiment shown in FIG. 1, the modular anti-vehicle barrier 1 comprises a plurality of anti-vehicle devices 2, which are arranged next to one another and are connected to one another in the way described below, so as to form a base B resting on the ground S, and a plurality of piles or rods or columns, which extend vertically from the base B in positions spaced apart from one another.

According to a preferred embodiment shown in FIGS. 1-6, the anti-vehicle devices 2 comprise: respective tubular support elements 3, which are spaced apart from and parallel to one another and extend along respective reference axes A, which are approximately vertical and are parallel to one another; respective bases 4 with a regular polygonal shape, which are designed to support the respective tubular support elements 3 and are arranged so as to abut against one another with the relative outer sides; fastening means 5, which are structured so as to connect the bases 4 to one another in order to form one single body making up the base of the modular anti-vehicle barrier 1.

According to a preferred embodiment shown in FIGS. 3, 5, 8 and 9, the anti-vehicle devices 2 further comprise friction elements 6, which are interposed between the bases 4 and the upper bearing surface S and are structured so as to generate a friction force which, in use, counters the movements of the modular anti-vehicle barrier 1 on the bearing surface S of the ground.

According to a preferred embodiment shown in FIGS. 1-9, the anti-vehicle devices 2 further comprise a plurality of loads or ballasts 7, which are designed to be coupled, in a firm, though easily removable (separable) manner, to the tubular support elements 3 so as to adjust the weight of the modular anti-vehicle barrier 1. According to a preferred embodiment shown in FIGS. 1-9, the ballasts 7 are shaped so as to form, with the tubular support elements 3, vertical columns (bollards), against which, in use, the vehicle hits.

According to a preferred explanatory embodiment shown in FIGS. 1-9, the ballasts 7 may comprise weight bars 7*a*, which are structured so as to be axially engaged and extracted into/from the inner chamber of the tubular support elements 3. The tubular support elements 3 and the weight bars 7*a* can preferably be structured and/or sized so as to allow them to be easily engaged/extracted, in a preferably telescopic manner, into/from the tubular support elements 3. The inner chamber of the tubular support elements 3 may conveniently have a circular cross section, whereas the weight bars 7*a* can comprise preferably solid cylindrical elements with an elongated shape, for example cylindrical rods or billets, which extend long the axis A in the inner chamber of the tubular support element 3. The weight bars 7*a* may preferably have an outer diameter that is rounded down to the inner diameter of the inner chamber of the tubular support element 3. The inner diameter of the inner chamber of the tubular support elements 3 may preferably range from approximately 250 mm to approximately 300 mm. The inner diameter of the inner chamber of the tubular support elements 3 can preferably be approximately 273 mm.

The tubular support elements 3 may preferably have a closed lower end, whereas the weight bars 7*a* can be sized so as to be at least partially arranged inside the tubular support element 3 with their lower end striking against the closed lower end thereof. The axial length of the weight bars 7*a* can preferably be greater than the axial length of the tubular support elements 3, so that the weight bars 7*a* project therefrom at the top with a predetermined length that depends on the height of the columns to be manufactured.

According to a preferred embodiment shown in FIGS. 1-9, the weight bars 7*a* can be shaped so as to have, at the top, a head 8 arranged immediately above the relative tubular support element 3, on the outside thereof.

Figure 7:
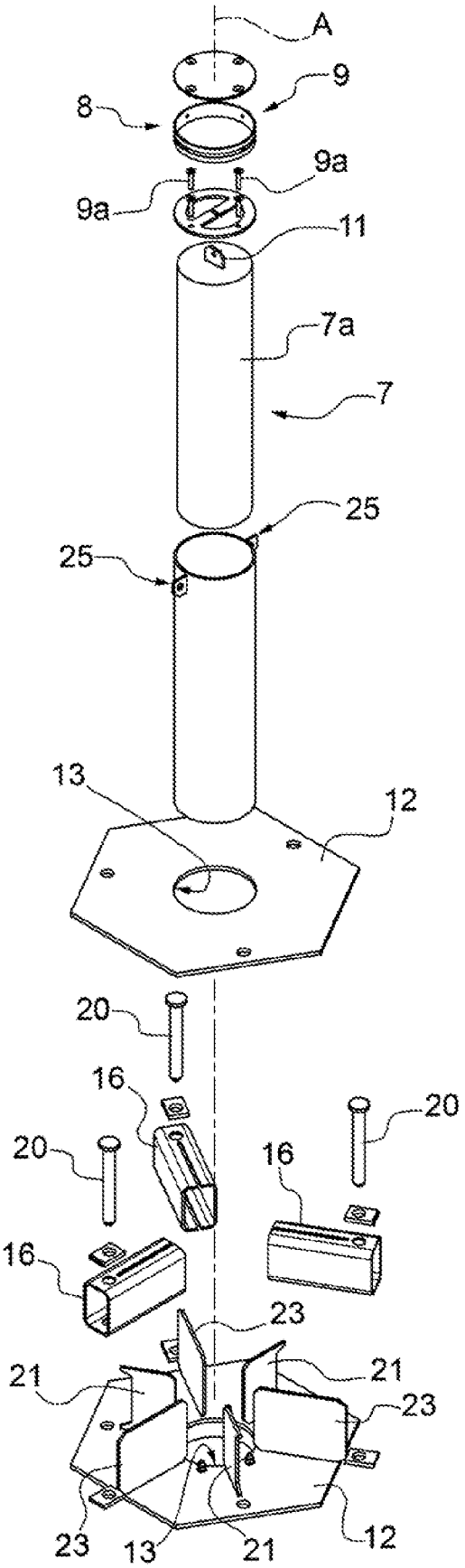
FIG. 7 is an exploded view of the anti-vehicle device shown in FIG. 4.

According to a preferred explanatory embodiment shown in FIG. 7, the head 8 can comprise an upper lid 9, which can be coupled, through fastening means, preferably screws 9*a*, to the upper end of the weight bar 7*a*. The lid 9 can consist of an upside-down cup-shaped body, which internally delimits, together with a flat surface of the upper end of the weight bar, an inner chamber. The inner chamber of the cup-shaped body can conveniently surround a hooking member 11, for example consisting of a vertical wing, which is firmly fixed on the flat surface of the upper end of the weight bar 7*a*. The wing can preferably have a through hole or a slot designed to be hooked, in use, by a hooking member or the like (not shown) so as to move the weight bar 7*a* during the assembly of the modular anti-vehicle barrier 1.

The shape and the structure of the lid 9 can be changed based on the use thereof. For example, the lid 9 can fulfil the task of supporting light sources. In this case, the lid 9 can be provided, for example, with seats or through holes, which emit the light generated by light sources, for example LEDs, installed in the lid 9 and/or in the inner chamber thereof and supplied with power by an electronic control circuit (not shown), which is conveniently arranged in the inner chamber.

Furthermore, the weight bars 7*a* can have two or more cylindrical portions with a different diameter, a first one of them being sized so as to be engaged in the tubular support element 3 and at least a second portion having, at the bottom, an annular portion or an abutment, which is shaped so as to rest on the upper annular edge of the tubular support element 3, in order to hold the second portion on the outside of and above the tubular support element 3.

The weight bars of the modular anti-vehicle barrier 1 can preferably have the same length.

According to a preferred explanatory embodiment shown in the accompanying Figures, the modular anti-vehicle barrier 1 has columns having approximately a same length. The axial length of the columns formed by the tubular support elements 3 and by the ballasts 7 can preferably ranges from approximately 0.9 m to approximately 1.5 m. The axial length of the columns can preferably be approximately 1 m.

However, the modular anti-vehicle barrier 1 may have columns having a different length. The length of the columns can change depending on the type of vehicle to be countered. The change in the length of the columns can involve the use of weight bars 7 and/or of tubular support elements having lengths that are different from one another. In a convenient configuration, the modular anti-vehicle barrier 1 can have columns with a greater length arranged along one or more outer sides so as to counter the first phase of the impact of the vehicle and columns with a smaller length arranged in the remaining parts of the barrier.

The weight bars 7*a* forming the ballasts 7 can conveniently be made of a metal material, preferably steel or the like. However, the invention is not limited to the use of metal weight bars 7*a* and it can provide, in addition or as an alternative, weight bars made of a different material, such as, for example, concrete or the like.

According to a preferred explanatory embodiment shown in FIGS. 1-9, the tubular support element 3 can be provided with two or more hooking wings 25, which radially project from the outer surface of the element 3 in diametrically opposite positions and can be provided with through holes designed, in use, to be anchored by means of the hooking members (not shown).

According to a preferred embodiment shown in FIGS. 1-9, the base 4 of the anti-vehicle device 2 can comprise base plates 12 with a regular polygonal shape, which lie on respective horizontal planes, which are approximately orthogonal to the axis A, in positions facing one another and spaced apart from one another. Each base plate 12 has, at the centre, a through hole 13 coaxial to the axis A, in which the tubular support element 3 is engaged.

Figure 2:
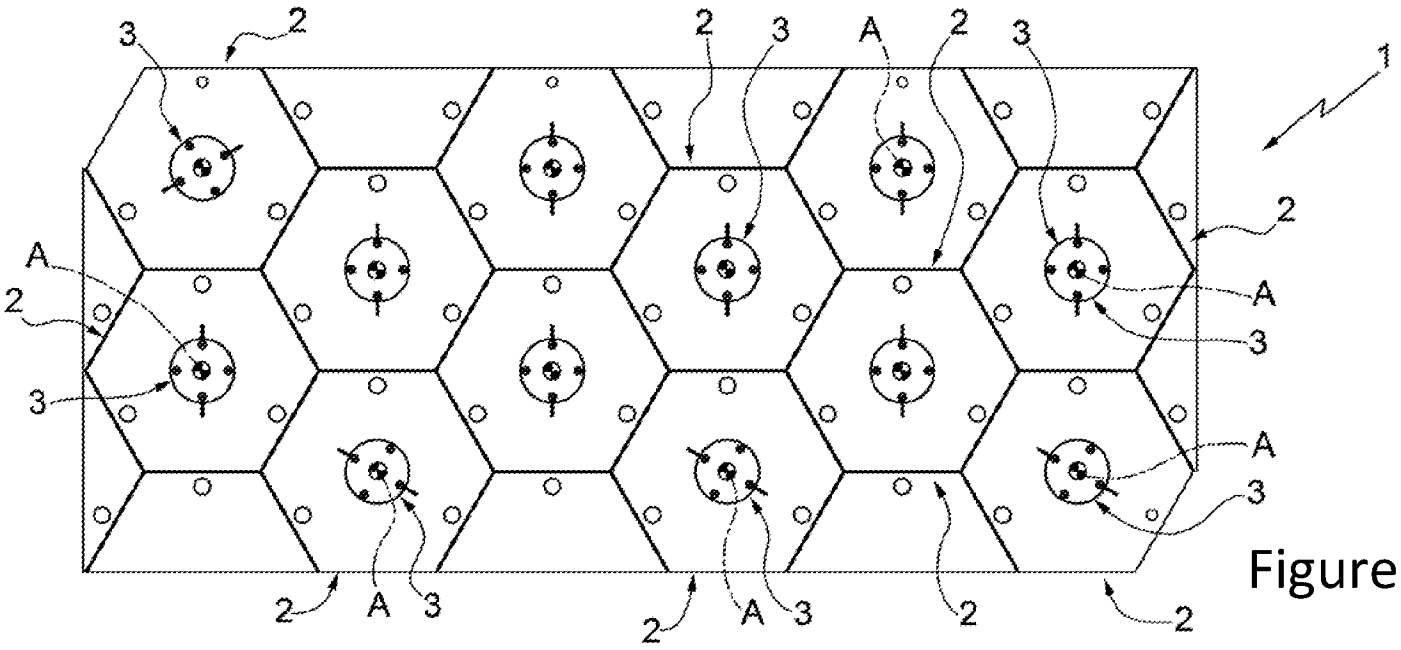
FIG. 2 is a plant view of the modular anti-vehicle barrier shown in FIG. 1.

According to a preferred explanatory embodiment shown in FIGS. 1-9, the base 4 of the anti-vehicle device 2 can comprise two base plates 12 with a conveniently hexagonal shape, which are arranged on top of one another and each have their own outer sides parallel to one another. The lower and upper base plates 12 of the anti-vehicle device 2 are arranged with their outer sides resting/in abutment against the corresponding outer sides of the lower and, respectively, upper base plates 12 of the adjacent anti-vehicle devices 2, so as to form a base B, which approximately has the structure of a honeycomb (FIG. 2). The Applicant found out that the base B with the honeycomb structure increases the compactness and the impact resistance of the modular anti-vehicle barrier 1. With reference to FIGS. 1-9, the lower and upper hexagonal base plates 12, when arranged next to one another, determine a mutual positioning of the columns, in which each column is arranged in a vertex of a triangular geometrical figure.

The upper base plate 12 of the anti-vehicle device 2 can preferably have approximately the same dimensions as the lower base plate 12. The two base plates 12 can preferably have a thickness ranging from approximately 10 to approximately 20 mm. The two base plates 12 can preferably have a thickness of approximately 15 mm. The opposite parallel sides of the two hexagonal base plates 12 can preferably have a distance from one another ranging from approximately 700 to approximately 900 mm, preferably equal to approximately 866 mm. The base plates 12 are preferably sized so that the distance between the centres of the tubular support elements 3 of two adjacent anti-vehicle devices 2 ranges from approximately 800 to approximately 900 mm, is preferably equal to approximately 873 mm.

The plates 12 can preferably consists of metal sheets. The tubular support element 3 can be firmly fixed to the metal sheets in the area of the holes 13, for example through welds.

Figure 3:
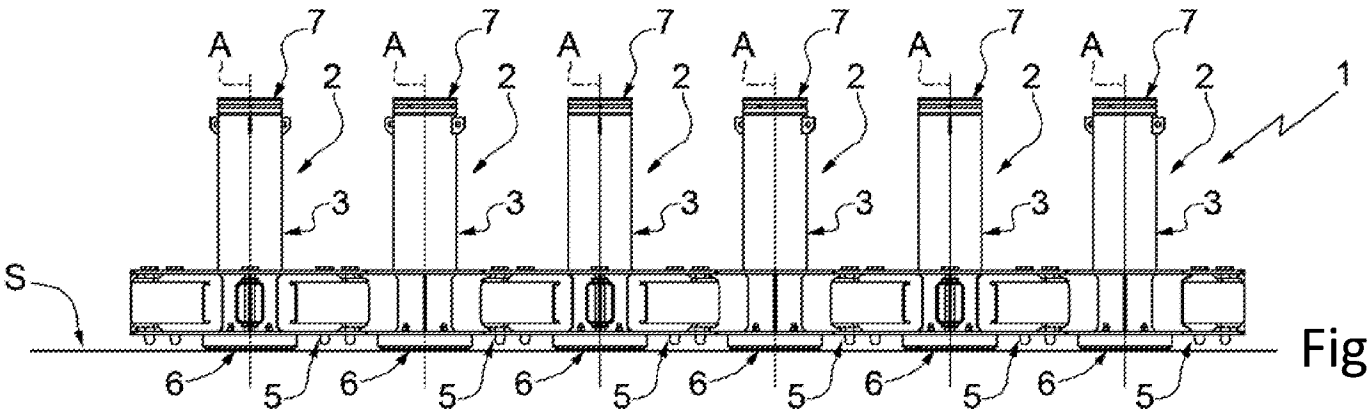
FIG. 3 is a side elevation view of the modular anti-vehicle barrier shown in FIG. 1.
Figure 4:
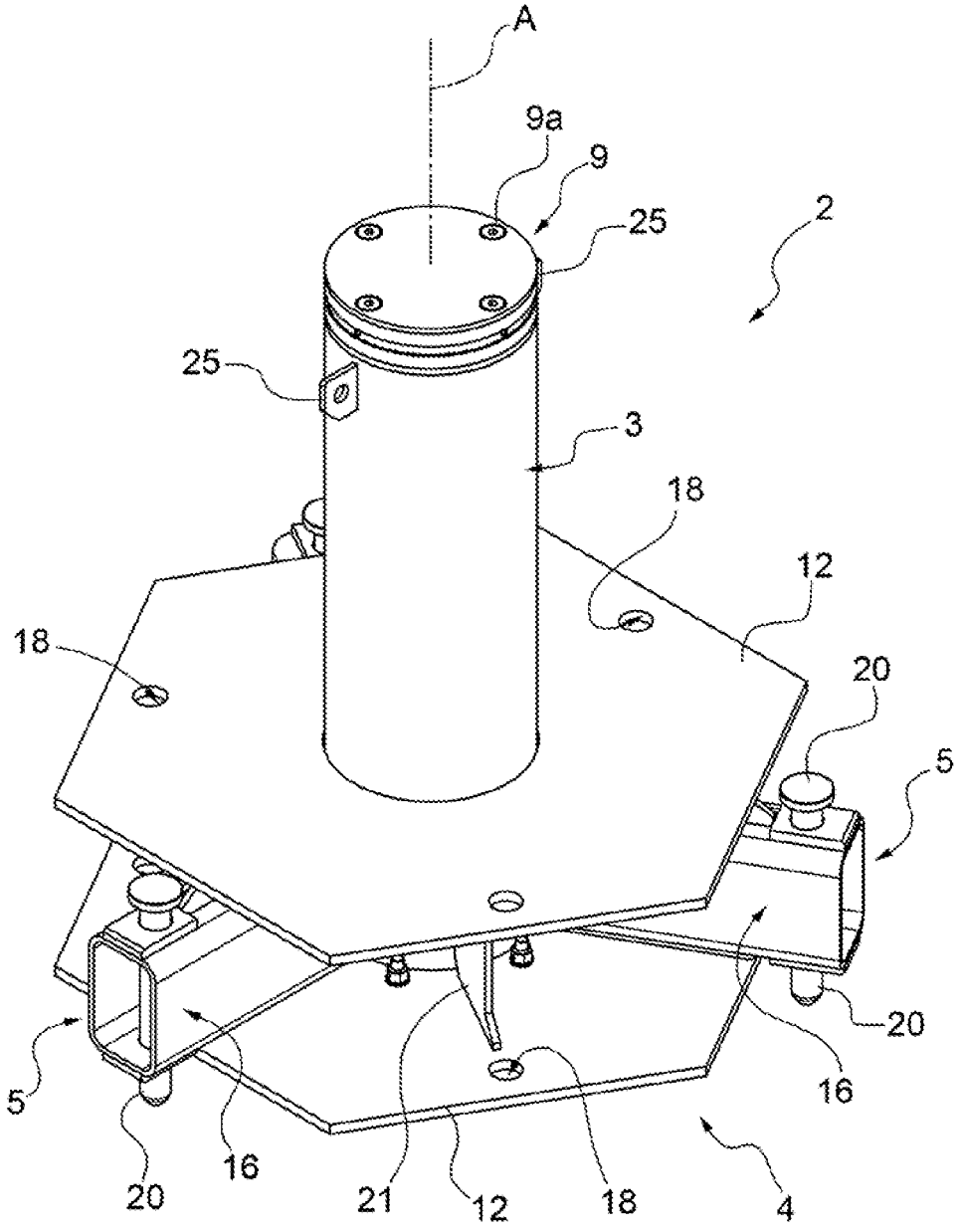
FIG. 4 is an axonometric view of one of the anti-vehicle devices making up the modular anti-vehicle barrier shown in FIG. 1.
Figure 5:
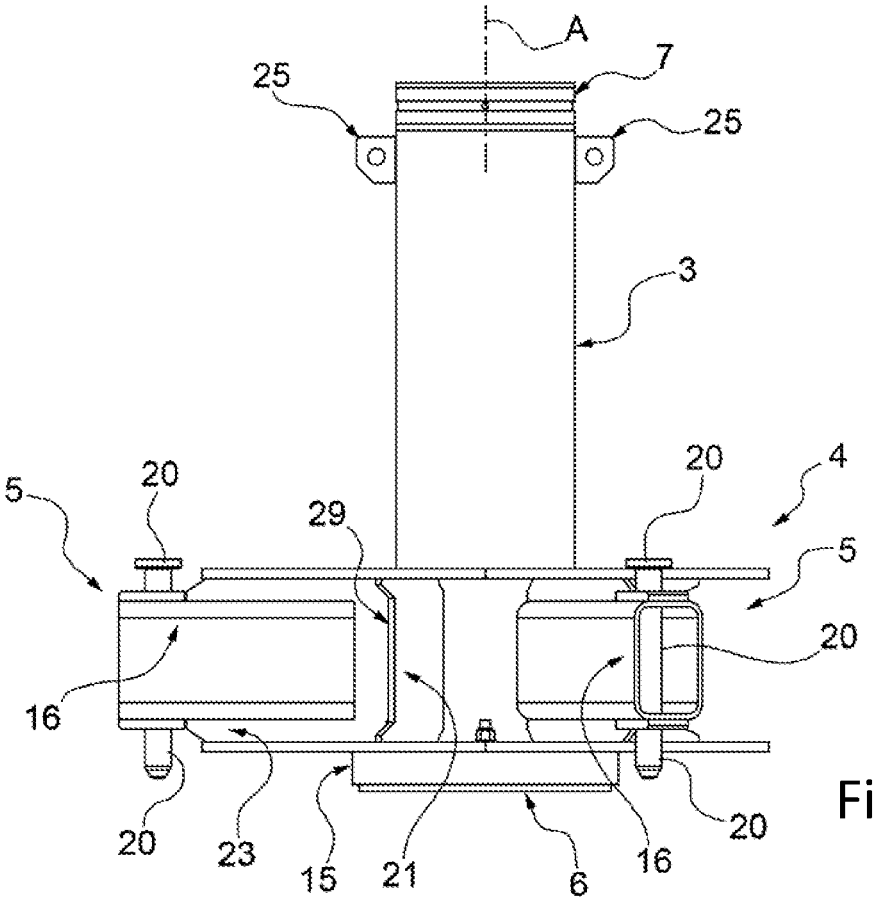
FIG. 5 is a side elevation view of the anti-vehicle device shown in FIG. 4.
Figure 6:
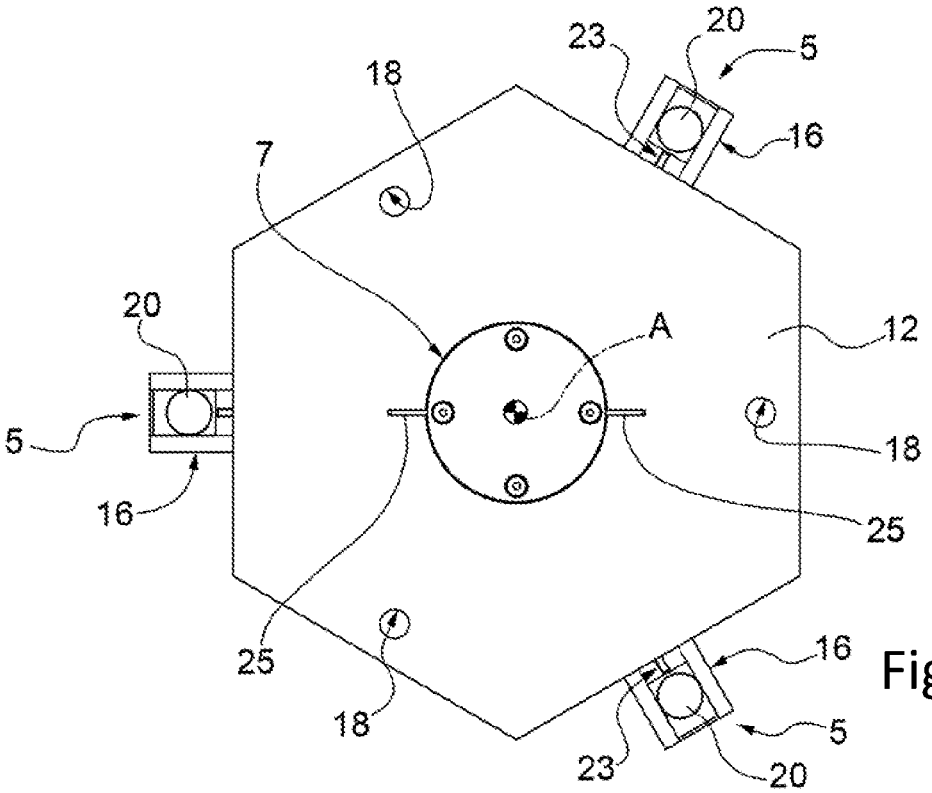
FIG. 6 is a plan view of the anti-vehicle device shown in FIG. 4.
Figure 8:
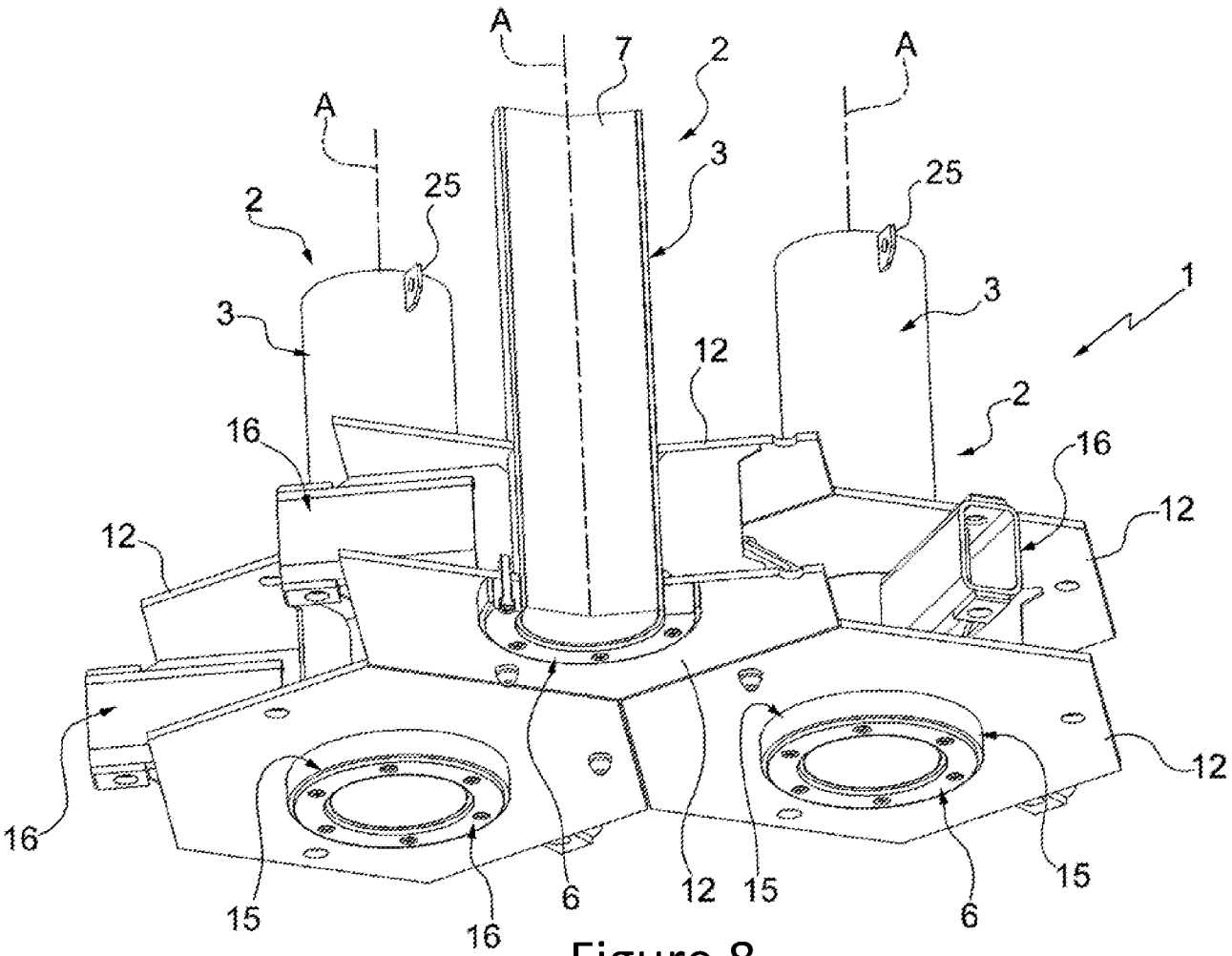
FIGS. 8 and 9 are two axonometric views, from two different perspectives, with sectional parts and parts removed for greater clarity, of the modular anti-vehicle barrier shown in FIG. 1.
Figure 9:
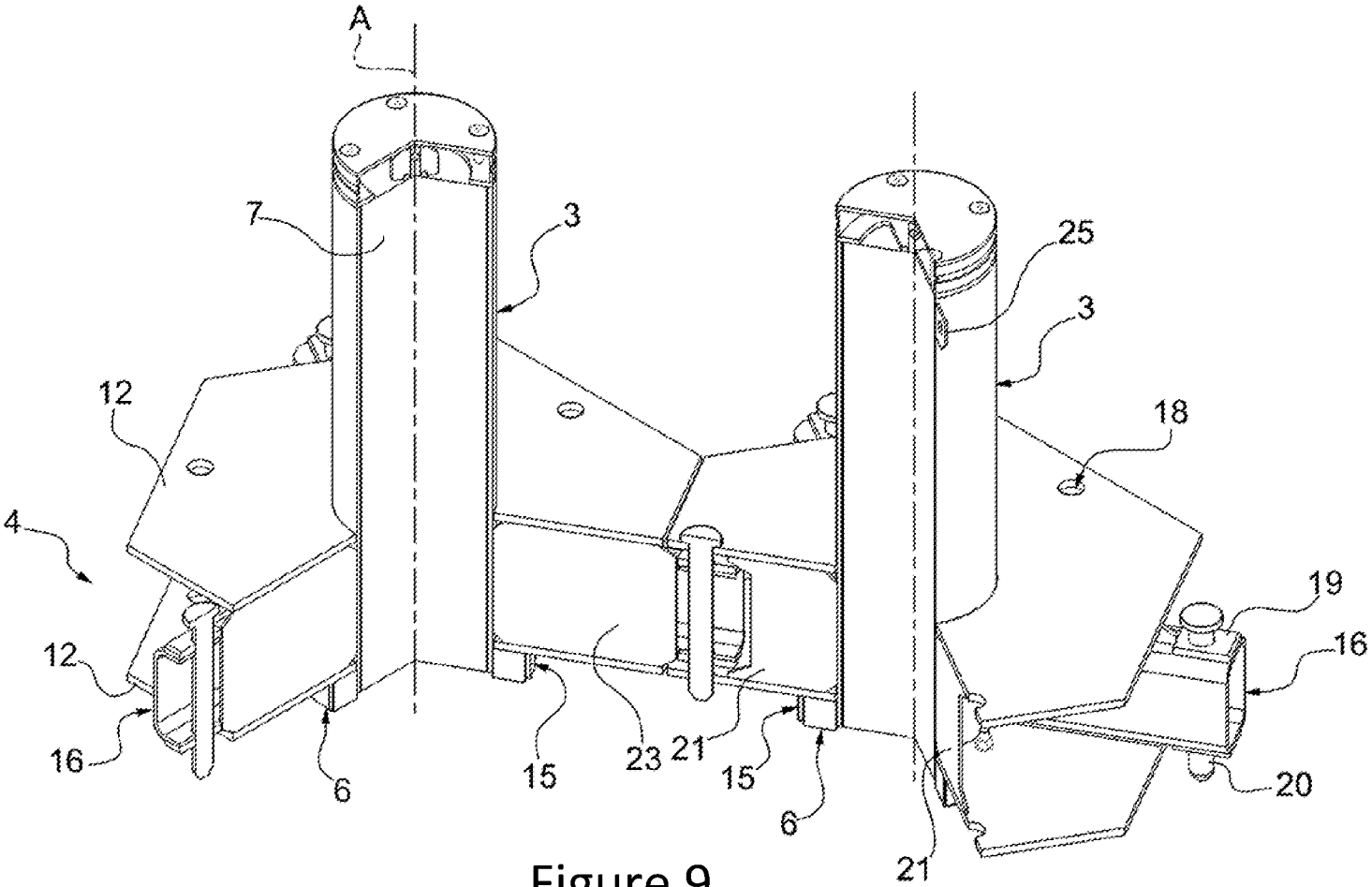
Figure 10:
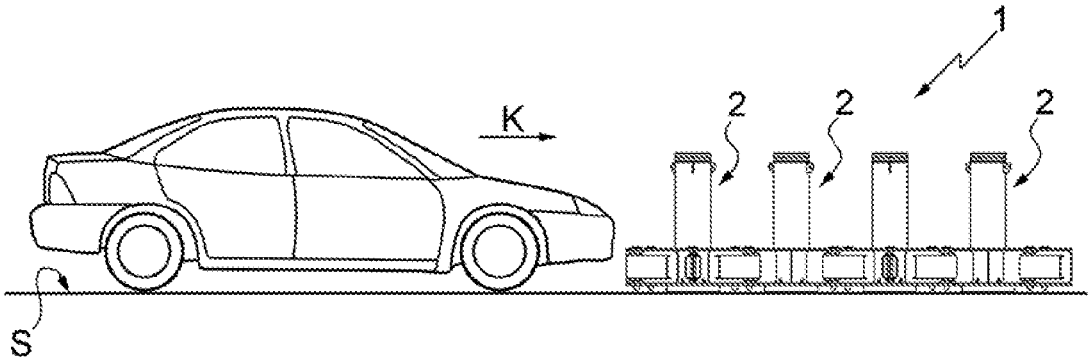
FIGS. 10 to 14 show, in sequence, the vehicle stopping action carried out by the modular anti-vehicle barrier shown in FIG. 1.
Figure 11:
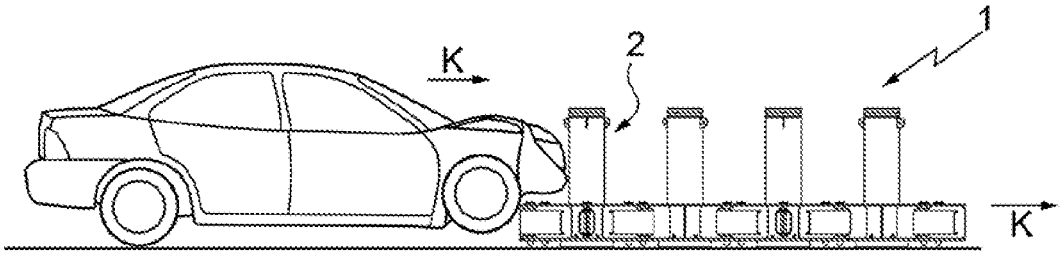

According to a preferred embodiment shown in FIGS. 3, 8 and 9, the friction elements 6 can be firmly coupled on the lower end of the tubular support elements 3 so as to rest on/be in abutment against the upper bearing surface of the ground S. According to a convenient explanatory embodiment shown in FIGS. 3, 8 and 9, the lower end of the tubular support element 3 can axially project under the lower base plate 12. The friction element 6 can preferably comprise a socle or base, preferably with an annular shape, which is engaged in an annular seat delimited, on the inside, by the projecting portion of the lower end of the tubular support element 3 and, on the outside, by an annular metal frame 15, which has the upper circular edge integral to the lower edge of the lower base plate 12.

The friction element 6 can be firmly fixed in the annular seat by means of fastening means. The fastening means can comprise screws, whose stems go through the body of the base and are screwed with the ends onto the tubular support element 3. The fastening means can comprise, as an alternative and/or in addition, an adhesive material.

The friction elements 6 can preferably be made of a rubber material or of similar elastic materials. For example, the Applicant found it convenient to use friction elements 6 made of natural rubber, such as for example "NR-CR" rubber, usually known as "bridge-bearing rubber". The Applicant further found it convenient to use annular bases having a thickness that, measured along the axis A, ranges from approximately 4 mm to approximately 10 mm, is preferably equal to approximately 8 mm.

According to a preferred embodiment shown in FIGS. 1-9, the fastening means 5 of each anti-vehicle device 2 comprise male connection elements and female connection elements, which are designed to be selectively coupled to and uncoupled from female connection elements and, respectively, male connection elements available in adjacent anti-vehicle devices 2.

According to a preferred explanatory embodiment shown in FIGS. 1-9, the anti-vehicle device 2 can comprise three male connection members and three female connection members arranged so as to alternate with one another. The male connection members of the anti-vehicle device 2 can preferably comprise three tubular male elements 16 with an elongated shape, which are angularly equally spaced apart from another, each extending radially starting from the tubular support element 3 along an axis that is substantially transverse to the reference axis A. The tubular male element 16 preferably extends along an axis that is approximately parallel to a relative apothem of the base plate 12 and has an approximately rectangular cross section.

The male tubular element 16 has an inner axial end integral to the tubular support element 3 and/or to the base plates 12 and an opposite free axial end, which stretches beyond the sides of the base plates 12, so as to at least partially project into the two base plates 12 of an adjacent anti-vehicle device 2.

Each male tubular element 16 can preferably be integral to the tubular support element 3 through a rectangular partition 23, which is arranged between the two base plates 12 on a lying plane orthogonal thereto and is integral to them and/or to the tubular support element 3, for example through welds. The partition 23 can be engaged in two longitudinal openings or slits obtained at the centre on the upper and lower sides of the tubular support element 3 and is integral to the tubular male element 16, for example through welds.

On the other hand, as to the female connection members of the anti-vehicle device 2, they can comprise first through holes 18, which are obtained in the lower and upper base plates 12 so as to be coaxial to a shared vertical axis parallel to said reference axis A, and second through holes 19, which are obtained in the free axial end of the tubular male element 16.

According to a preferred embodiment, the anti-vehicle device 1 is further provided with cylindrical connection pins 20, which are firmly engaged, though in an easily removable manner, in the respective first holes 18 and second holes 19, so as to create the connection of the tubular male elements 16 to the base plates 12 of the adjacent anti-vehicle devices 1.

According to a first embodiment shown in the accompanying Figures, the holes 18 can conveniently be made in the lower and upper plates 12 in the area of the central portion of the outer sides, so as to be coaxial to the pair of holes 19 present in the end of a tubular male element 16 of an adjacent anti-vehicle device 1.

According to a preferred embodiment shown in FIGS. 1-9, the modular anti-vehicle device 2 can further comprises a series of vertical and preferably rectangular stiffening partitions 21, each arranged between the base plates 12 on a vertical plane going through the axis of the holes 18.

The stiffening partitions 21 can preferably comprise three vertical and rectangular plate-like elements integral to the tubular support element 3 and/or to the base plates 12 and have the outer end having a recess 29 that is sized so as to accommodate the free axial end of a tubular male element 16 of an adjacent modular anti-vehicle device 2.

According to a preferred embodiment, the modular anti-vehicle barrier 1 can be provided with a protection frame, which is arranged long the outer perimeter of the barrier itself so as to cover the exposed edges of the base plates 12. The protection frame can preferably comprise vertical protection panels, which are structured so as to be fixed on the sides of the base plates 12 in order to cover them. Each protection panel can comprise an inner core made of a rigid material for example metal, and covered on the outside by a soft material layer. The rigid inner core can preferably be C-shaped so that it can be coupled in an interlocking manner to the outer sides of the base plate 12.

Hereinafter there is a description of the method for achieving the modular anti-vehicle barrier 1, which involves the protection of a road where the surface of the ground corresponds to the road surface and in which the anti-vehicle devices 2 are provided with hexagonal bases 4.

The method comprises the steps of placing a predetermined number of anti-vehicle devices 2 in positions next to one another and with the bases 4 next to one another and the friction elements 6 resting on the road surface. The bases 4 are placed next to one another by arranging the outer side of a base 4 of an anti-vehicle device 2 in abutment against an outer side of the base 4 of another anti-vehicle device 2. Obviously, the bases 4 are placed next to one another, on the one hand, by arranging the outer sides of two lower and upper plates 12 of an anti-vehicle device in abutment against the outer sides of the two lower and, respectively, upper plates 12 of an adjacent anti-vehicle device 1 and, on the other hand, by aligning the holes 19 of the tubular male element 16 of an anti-vehicle device 2 with the holes 18 available in the base plates 12 of the other anti-vehicle device 2.

The method further comprises the step of engaging the cylindrical pins 20 in the holes 18, so as to connect the anti-vehicle devices 2 in pairs. The mutual connection of the bases 4 of the anti-vehicle devices 2 forms one single body making up the base B of the barrier 1.

The method further comprises the step of coupling the ballasts 7 to the tubular support element 3 so as to adjust the weight and/or the height of the modular anti-vehicle barrier 1.

The number of modular anti-vehicle devices 2 can conveniently be changed depending on the surface of the area to be protected.

Figure 12:
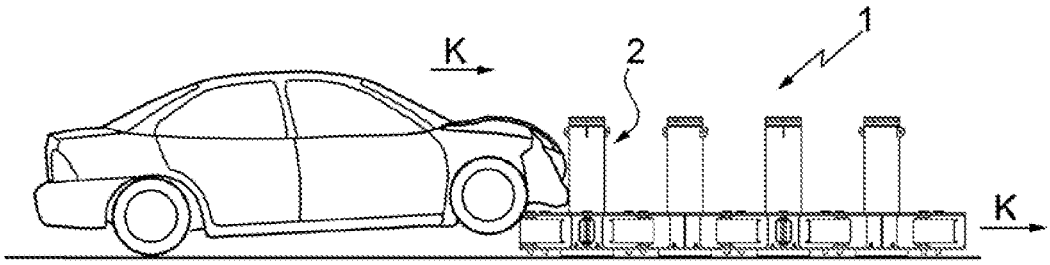
Figure 13:
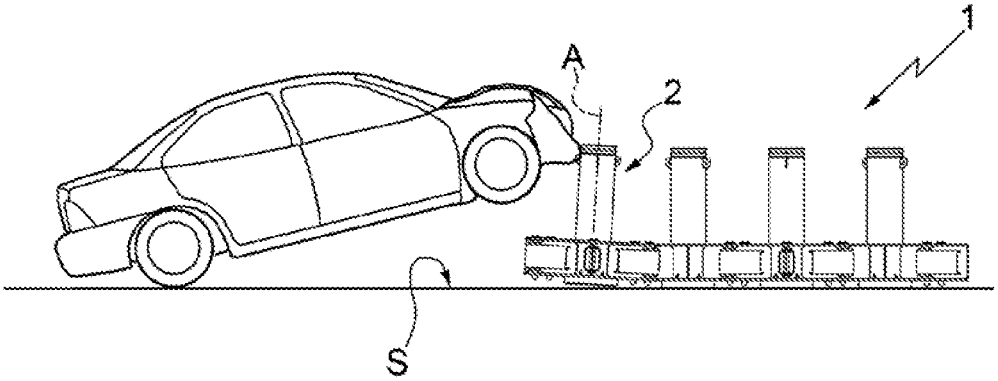
Figure 14:
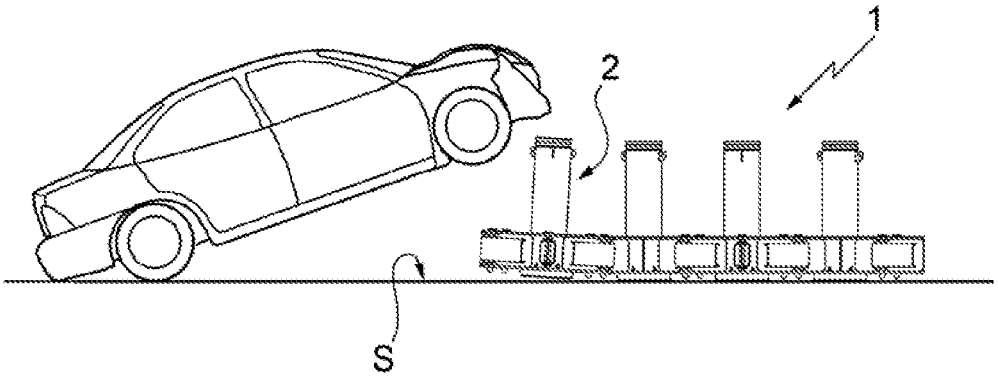

FIGS. 10-14 show an example of the operation of the modular anti-vehicle barrier 1, assuming that a vehicle is driving in a direction K. When the vehicle reaches the modular anti-vehicle barrier 1 (FIGS. 10 and 11), its front part hits the base B, thus being damaged. Following the first impact, the wheel overcomes the base B so that the vehicle hits the columns of the first row (FIGS. 12 and 13). The impact with the columns causes the vehicle to significantly slow down and/or stop and to be lifted from the upper part, which subsequently, in case the vehicle does not completely stop, hits the following columns. During the impact, the friction elements 6 counter the movement of the modular anti-vehicle barrier 1 on the ground S.

Tests carried out by the Applicant proved that a modular anti-vehicle barrier 1 consisting of ten anti-vehicle devices 2, when subjected to an impact of a vehicle of approximately 1500 Kg with an impact speed of 48 Km/h, moves of approximately 300 mm.

It should be pointed out that, during the impact, the columns are capable of flexing thanks to the clearances present between the anti-vehicle devices and the friction elements. As a consequence, the columns do not plastically deform and the anti-vehicle device 2 subjected to the impact can conveniently be used again.

The advantages of the barrier are the following. First of all, the anti-vehicle barrier, thanks to is modular structure and its assembling simplicity allows users to change the protection configurations of a site based on the needs established by the features of the site itself and/or by specific protection requests/needs or strategies. This versatility, indeed, allows the protection system to be adjusted each time based on the requested degree of protection.

Furthermore, the anti-vehicle barrier is not too invasive from the point of view of the landscape aesthetic appeal and, therefore, is suited to be also installed in valuable city areas. Finally, the anti-vehicle barrier, besides being easily transportable thanks to its modular structure, it capable of neutralizing the ride of a vehicle regardless of the direction thereof.

The invention claimed is:

1. An anti-vehicle device (2) for achieving a modular anti-vehicle barrier (1) designed to be freely arranged resting on an upper surface of the ground (S), characterised in that it comprises:

a tubular support element (3) which extends along a vertical reference axis (A), a regular polygonal shaped base (4), which is designed to support said tubular element, fastening means (5) for connecting said base (4) to the bases (4) of the other adjacent anti-vehicle devices (2) thus forming with the same a single body which constitutes a base (B) of said anti-vehicle barrier (1);

friction means (6) which are interposed between the base (4) and the upper resting surface of the ground (S) and are structured to counter by friction the movement of the anti-vehicle barrier (1) on the upper surface of the ground (S), and a ballast (7) which is designed to be coupled, in an easily removable manner, to said tubular support element (3) for adjusting the weight and/or the height of said anti-vehicle barrier (1), said ballast (7) comprises a weight bar (7*a*) structured for being easily engaged and extracted in/from said respective tubular support element (3), each base (4) comprises two base plates (12) which are arranged on two relative horizontal planes spaced apart, said tubular support element (3) is firmly engaged in two through holes (13) which are bored at the centre on two base plates (12) coaxial to said reference axis (A), said friction means (6) comprising bases in gum-like material, which are coupled onto the lower ends of said tubular support elements (3) for being arranged resting on the upper bearing surface of the ground.

2. The anti-vehicle barrier according to claim 1, wherein said fastening means (5) of each said anti-vehicle device (2) comprise male connection elements and female connection elements designed to be selectively coupled and uncoupled with female connection elements and respectively, male connection elements of the adjacent anti-vehicle devices (2).

3. The anti-vehicle barrier according to claim 2, wherein said male connection elements of each anti-vehicle device (2) comprise three tubular elements (16) having an elongated shape angularly equispaced from one another, each of which extends radially from the tubular support element (3) in order to extend between the two base plates (12) and project with the free end between the two base plates (12) of an adjacent anti-vehicle device (2).

4. The anti-vehicle barrier according to claim 2, wherein the female elements of the anti-vehicle devices (2) comprise first through holes (18) which are obtained on the two base plates (21) in order to be coaxial to a shared axis parallel to said reference axis (A), second through holes (19) which are bored on the projecting free end of said male tubular element (16) and are coaxial to said shared axis; said anti-vehicle device (2) further comprising, pins (20) designed to be engaged in an easily extractable manner in said first holes (18) and said second holes (19).

* * * * *